US010840629B2

(12) United States Patent
Ben Shoshan

(10) Patent No.: US 10,840,629 B2
(45) Date of Patent: Nov. 17, 2020

(54) EDGE CARD ADAPTER AND ELECTRICAL COUPLING DEVICE

(71) Applicant: BIOSENSE WEBSTER (ISRAEL) LTD., Yokneam (IL)

(72) Inventor: Sharona Ben Shoshan, Zichron Yaacov (IL)

(73) Assignee: Biosense Webster (Israel) Ltd., Yokeam (IL)

( * ) Notice: Subject to any disclaimer, the term of this patent is extended or adjusted under 35 U.S.C. 154(b) by 294 days.

(21) Appl. No.: 15/634,155

(22) Filed: Jun. 27, 2017

(65) Prior Publication Data

US 2018/0375245 A1 Dec. 27, 2018

(51) Int. Cl.

| | |
|---|---|
| ***H01R 12/72*** | (2011.01) |
| ***H01R 13/24*** | (2006.01) |
| ***H01R 12/71*** | (2011.01) |
| ***H01R 11/03*** | (2006.01) |
| ***H01R 12/70*** | (2011.01) |
| ***H01R 13/516*** | (2006.01) |
| ***H01R 24/20*** | (2011.01) |
| ***H01R 24/28*** | (2011.01) |
| ***H01R 43/20*** | (2006.01) |
| *H01R 12/75* | (2011.01) |

(52) U.S. Cl.

CPC ..... *H01R 13/2457* (2013.01); *H01R 11/03* (2013.01); *H01R 12/7029* (2013.01); *H01R 12/714* (2013.01); *H01R 12/72* (2013.01); *H01R 12/721* (2013.01); *H01R 13/2492* (2013.01); *H01R 13/516* (2013.01); *H01R 24/20* (2013.01); *H01R 24/28* (2013.01); *H01R 43/205* (2013.01); *H01R 12/75* (2013.01)

(58) Field of Classification Search

CPC ..... H01R 12/721; H01R 13/2457

See application file for complete search history.

(56) References Cited

U.S. PATENT DOCUMENTS

| | | | | |
|---|---|---|---|---|
| 4,380,119 A * | 4/1983 | Normann | ..... | H01R 43/24 29/884 |
| 4,932,885 A | 6/1990 | Scholz | | |
| 5,088,009 A * | 2/1992 | Harada | ..... | H01R 12/721 361/787 |

(Continued)

OTHER PUBLICATIONS

European Search Report dated Feb. 14, 2019 from corresponding European Patent Application No. 18179769.7.

*Primary Examiner* — Tho D Ta

(57) ABSTRACT

An edge card connector assembly has a harness-side portion connectable to a cable and a card-side portion adapted to receive a planar structure edgewise therein in a plane of entry. The edge card connector has a plurality of resilient electrical contacting members extending through the wall and is adapted for electrical connection with the cable in the harness-side portion and with the planar structure in the card-side portion. Upper and lower contacting members are disposed above and below the plane, respectively, such that the received planar structure impinges on the contacting members to urge the upper and lower contacting members away from the plane, and the upper and lower contacting members exert opposing holding pressure on the upper and lower surfaces of the planar structure at respective contact points.

9 Claims, 3 Drawing Sheets

(56) References Cited

U.S. PATENT DOCUMENTS

| | | | | |
|---|---|---|---|---|
| 5,141,445 | A * | 8/1992 | Little | H01R 12/57 439/108 |
| 5,329,428 | A | 7/1994 | Block et al. | |
| 5,694,296 | A | 12/1997 | Urbish et al. | |
| 5,997,343 | A | 12/1999 | Mills et al. | |
| 6,099,354 | A | 8/2000 | Troyan | |
| 6,129,562 | A * | 10/2000 | Hong | H01R 12/721 439/607.32 |
| 6,276,943 | B1 | 8/2001 | Boutros et al. | |
| 6,341,988 | B1 * | 1/2002 | Zhu | H01R 12/721 439/630 |
| 6,741,480 | B2 | 5/2004 | Hartke et al. | |
| 6,953,350 | B2 * | 10/2005 | Shiu | H01R 12/87 439/79 |
| 7,866,993 | B2 | 1/2011 | Ohsumi | |
| 8,177,782 | B2 | 5/2012 | Beller et al. | |
| 8,277,232 | B2 * | 10/2012 | Herring | H01R 4/028 439/79 |
| 8,450,620 | B2 * | 5/2013 | Cai | H01R 12/721 174/250 |
| 9,306,306 | B2 * | 4/2016 | Nishio | H01R 13/533 |
| 9,893,441 | B2 * | 2/2018 | Moriyasu | H01R 12/7005 |
| 2013/0109201 | A1 | 5/2013 | Wu et al. | |
| 2013/0296729 | A1 | 11/2013 | Datta | |
| 2013/0316586 | A1 | 11/2013 | Nagamine | |
| 2015/0150547 | A1 | 6/2015 | Ingmanson et al. | |

* cited by examiner

EDGE CARD ADAPTER AND ELECTRICAL COUPLING DEVICE

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to electrical coupling devices. More particularly, this invention relates to an electrical coupling device for coupling with the edge of planar structures such as rigid printed circuit boards.

2. Description of the Related Art

The meanings of certain acronyms and abbreviations used herein are given in Table 1.

TABLE 1

| Acronyms and Abbreviations | |
|---|---|
| PCB | Printed Circuit Board |
| HSSDC | High Speed Serial Data Connector |

Connecting to circuitry formed on a printed circuit board (PCB) typically requires soldering wires and connectors to the PCB. The soldering takes time and requires soldering equipment. In addition, if for any reason the PCB needs to be removed, the wires and connectors need to be desoldered, again taking time and requiring special equipment.

The art has made attempts to improve contact reliability between terminal fittings and a circuit board. These typically involve bringing terminal fittings resiliently into contact with juxtaposed components on an edge portion of a circuit board. For example, U.S. Pat. No. 6,276,943 proposes a connector adapted to High Speed Serial Data Connector (HSSDC) system made up of a modular plug and a receptacle having a polarization slot that may be connected to each other and assembled to the connector using a modular design that does not require any pre-soldering.

U.S. Pat. No. 5,997,343 describes a sensor plug that is pushed into the insertion slot a sensor connector. As the sensor plug is inserted, the leading edge engages spring contacts, lifting the spring contacts and causing two of the spring contacts to touch a switch contact. As insertion of the sensor plug continues, a sensor tab slides between a contact block and a bottom case such that the spring contacts and the plug contacts remain electrically connected.

SUMMARY OF THE INVENTION

Application of the existing methods to a catheter handle design incurs a high labor and material cost, as the use of relatively expensive flex-rigid PCB is required to meet spatial constraints in a catheter handle. Assembly of devices such as catheter handles using adapters constructed according to the invention is simplified, with substantial reduction in both labor and material costs. The adapter can accommodate inexpensive PCBs, (rigid PCB).

Embodiments of the invention provide an adapter, which connects to pads of a PCB by sliding into the edge of the PCB, rather than by soldering. The adapter has a set of two-sided connections. On the side of a connection receiving the PCB there is a spring-loaded conducting "finger", which terminates in an "elbow" that is configured to contact a PCB pad. On the other side of the connection is a male pin or a female socket. The adapter is enclosed in a casing, and there are guides formed in the casing, which direct the PCB to mate with the fingers of the adapter, such that the elbows of the fingers mate with the pads.

There is provided according to embodiments of the invention an edge card connector assembly, including a housing having a card-side portion, a harness-side portion connectable to a cable and a wall therebetween. The card-side portion is adapted to receive a planar structure edgewise therein in a plane of entry. The edge card connector has a plurality of resilient electrical contacting members extending through the wall and is adapted for electrical connection with the cable in the harness-side portion and with the planar structure in the card-side portion. Upper and lower contacting members are disposed above and below the plane, respectively, such that the received planar structure impinges on the contacting members to urge the upper and lower contacting members away from the plane, and the upper and lower contacting members exert opposing holding pressure on the upper and lower surfaces of the planar structure at respective contact points.

According to a further aspect of the assembly, the contacting members comprise a finger portion and an elbow, the finger portion extending generally from the wall to the elbow. The elbow of at least a portion of the contacting members makes galvanic contact with the planar structure at the one of the respective contact points.

According to an additional aspect of the assembly, the finger portion is resilient.

According to another aspect of the assembly, the contacting members are arranged as an upper set of rows above the plane and a lower set of rows below the plane.

According to an additional aspect of the assembly, the upper set of rows and the lower set of rows total five rows.

According to one aspect of the assembly, there are three rows in the upper set of rows and two rows in the lower set of rows.

According to still another aspect of the assembly, there are 34 contacting members.

According to a further aspect of the assembly, the card-side portion of the housing has opposing side walls and a pair of slots formed in the side walls, the slots defining the plane and receiving the planar structure therein.

According to one aspect of the assembly, the slots terminate at the wall.

According to yet another aspect of the assembly, in the harness-side portion the contacting members terminate as pin connectors for the cable.

According to still another aspect of the assembly, in the harness-side portion the contacting members terminate as socket connectors for the cable.

According to yet another aspect of the assembly, the planar structure is a printed circuit board has electrical contacts that mate with the contacting members at the contact points.

There is further provided according to embodiments of the invention a method, which is carried out by providing a handle in a catheter. The handle has an edge card connector disposed therein. The method is further carried out by connecting an edge card and a cable harness to the edge card connector, wherein the edge card connector includes a housing having a card-side portion, a harness-side portion connectable to the cable harness and a wall therebetween. The card-side portion is adapted to receive a planar structure edgewise therein in a plane of entry. The edge card connector has a plurality of resilient electrical contacting members extending through the wall and is adapted for electrical connection with the cable in the harness-side portion and with the planar structure in the card-side portion. Upper and lower contacting members are disposed above and below the plane, respectively, such that the received planar structure impinges on the contacting members to urge the upper and lower contacting members away from the plane, and the upper and lower contacting members exert opposing holding pressure on the upper and lower surfaces of the planar structure at respective contact points.

BRIEF DESCRIPTION OF THE SEVERAL VIEWS OF THE DRAWINGS

For a better understanding of the present invention, reference is made to the detailed description of the invention, by way of example, which is to be read in conjunction with the following drawings, wherein like elements are given like reference numerals, and wherein.

DETAILED DESCRIPTION OF THE INVENTION

In the following description, numerous specific details are set forth in order to provide a thorough understanding of the various principles of the present invention. It will be apparent to one skilled in the art, however, that not all these details are necessarily needed for practicing the present invention.

Documents incorporated by reference herein are to be considered an integral part of the application except that, to the extent that any terms are defined in these incorporated documents in a manner that conflicts with definitions made explicitly or implicitly in the present specification, only the definitions in the present specification should be considered.

Figure 1:
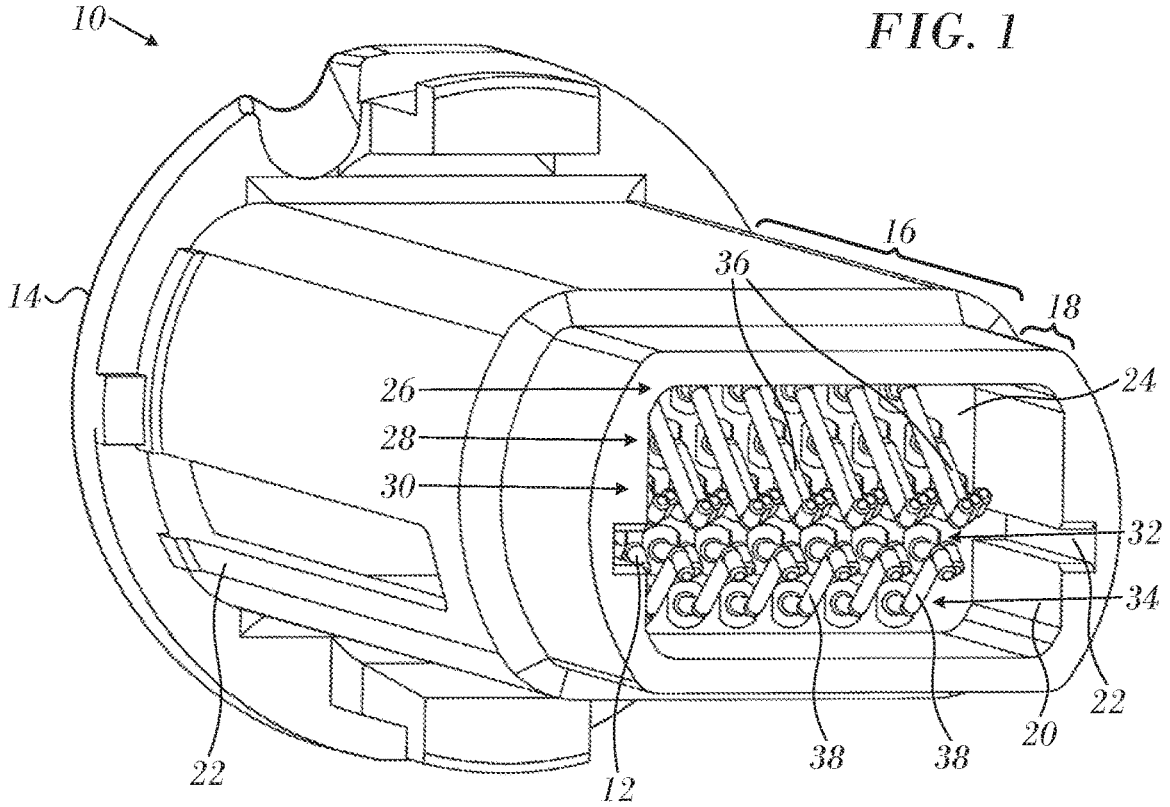
FIG. 1 is an oblique sectional card-side elevation through an edge card adapter in accordance with an embodiment of the invention.

Turning now to the drawings, reference is initially made to FIG. 1, which is an oblique sectional card-side (frontal) elevation through an edge card adapter 10 in accordance with an embodiment of the invention. Edge card adapter 10 has a housing 12, a rear flange 14, which is adapted for connection to a cable harness (not shown), an intermediate segment 16, which stabilizes the cable harness, and a card-coupling segment 18 into which a card such as a PCB is received edgewise. In one application the edge card adapter 10 is located inside a catheter handle, and functions as an interface capable of transmitting electric signals from a catheter circuit board via an extension cable receptacle connector. Catheter handles of this sort are described, e.g., in commonly assigned U.S. Patent Application Publication No. 2013/0296729, which is herein incorporated by reference.

The card-coupling segment 18, which can be made from plastic, comprises a walled chamber 20 having slots 22 formed therein to define a plane of entry. The slots 22 are suitably dimensioned to receive a card edgewise. In the example of FIG. 1 the slots 22 extend to a back wall 24 to form a stop for the card. Alternatively, the slots 22 may be shorter and not extend as far as the back wall 24.

Extending outward from the back wall 24 of the chamber 20 are an upper set of parallel rows 26, 28, 30 and lower set of parallel rows 32, 34 of springy upper contacting members 36 and lower contacting members 38 respectively located above and below the slots 22. The contacting members may be gold plated nickel. The terms "above", "below", "upward" and "downward", "upper" and "lower" are used arbitrarily herein to distinguish the relationships and movements of the upper contacting members 34 and lower contacting members 38 with respect to an edge card and slots 22. These terms have no physical meanings with respect to the actual configuration of the edge card adapter 10. In this example, there the upper set and lower set of rows comprise three rows and two rows, respectively. In other embodiments the number of rows may vary as may the number of contacting members in different rows. The density, i.e., proximity of neighboring contacting members, may be adjusted to the dimensions of the edge card.

Figure 2:
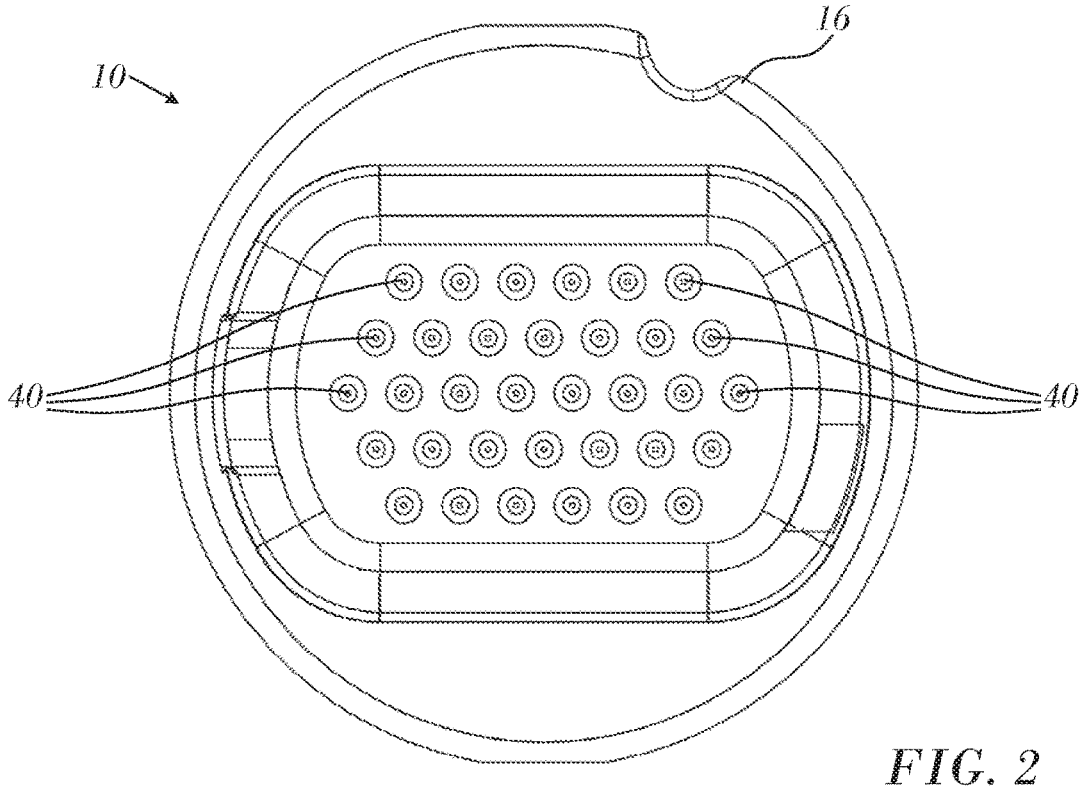
FIG. 2 is a harness-side sectional view through intermediate segment of the edge card adapter in accordance with an embodiment of the invention.

Reference is now made to FIG. 2, which is a harness-side (rear) sectional view through intermediate segment 16 of the edge card adapter 10, in accordance with an embodiment of the invention. Rearward extensions of the contacting members 36, 38 (FIG. 1) can be sockets that are adapted to mate with pins of a mating receptacle connector, which is part of a cable (not shown). Alternatively, the contacting members 36, 38 can be pins that are adapted to mate with sockets of the mating receptacle connector. This exemplary embodiment provides 34 contacts 40 divided among five parallel rows of contacting members: three upper rows 26, 28, 30 and two lower rows 32, 34.

Figure 3:
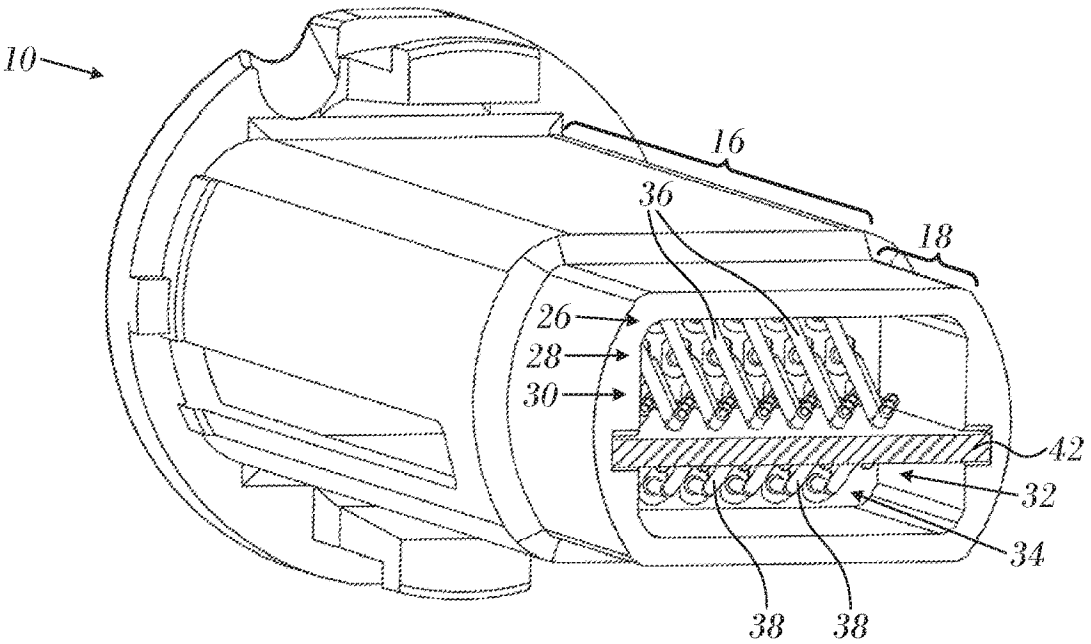
FIG. 3 is an oblique card-side elevation of the edge card adapter shown in FIG. 1 that includes an edge card in accordance with an embodiment of the invention.

Reference is now made to FIG. 3, which is an oblique card-side elevation of the edge card adapter 10 similar to FIG. 1 that includes a sectional view of an edge card 42, in accordance with an embodiment of the invention. The edge card 42, which can be a rigid circuit board, occupies the slots 22 (FIG. 1). The contacting members 36, 38 in the upper rows 26, 28, 30 and the lower rows 32 34 are springy and are displaced upward and downward, respectively, (i.e., away from a plane defined by the slots 22), by insertion of the edge card 42 into the slots 22 when the upper and lower surfaces of the edge card contacts the upper contacting members 36 and lower contacting members 38. All upper contacting members 36 and lower contacting members 38 act as wiping contacts with mating electrical contacts on the edge card. Insertion of the edge card 42 continues until the back wall 24 prevents further advancement of the edge card 42. The wiping contacts are self-cleaning in applications in which the edge card 42 is repeatedly inserted and removed from the edge card adapter 10.

Figure 4:
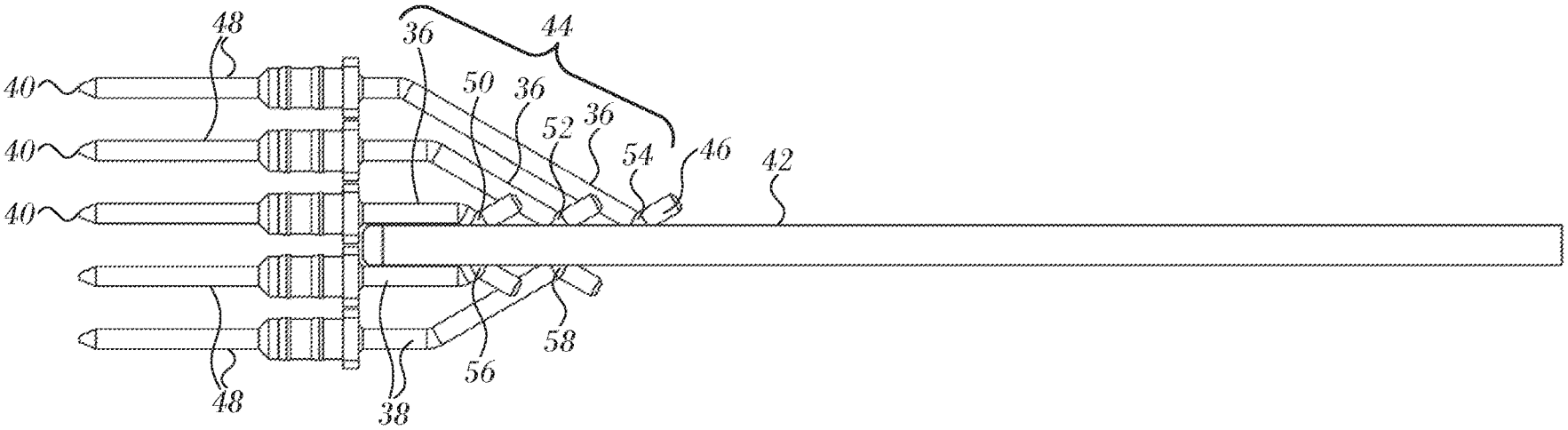
FIG. 4 is a side elevation of the contacting members of the edge card adapter shown in FIG. 1 with an edge card inserted in accordance with an embodiment of the invention.

Reference is now made to FIG. 4, which is a side elevation of the contacting members 36, 38 with edge card 42 inserted, in accordance with an embodiment of the invention. In their card-side segments, the contacting members have springy finger portions 44 terminating in elbows 46.

Contacts 40 appear at the harness-side extremities of pins 48. The upper surface of edge card 42 is pressed at pressure points 50, 52, 54 by the upper contacting members 36. The lower surface of edge card 42 is pressed at pressure points 56, 58 by the lower contacting members 38. All of the pressure points correspond to mating electrical contacts (not shown) on the edge card 42. Galvanic contact between the edge card 42 and the elbows 46 of the upper contacting members 36 and the lower contacting members 38 is achieved without soldering.

Alternate Embodiment

Figure 5:
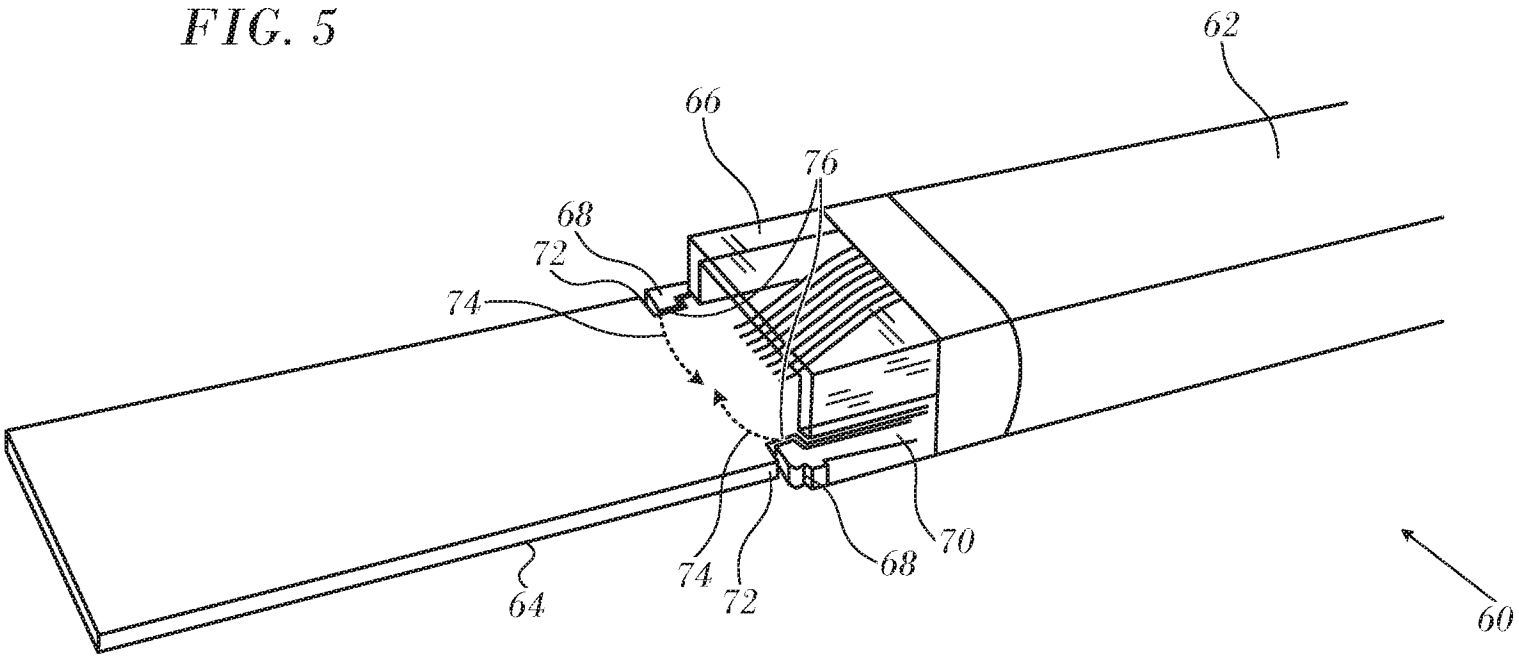
FIG. 5 is an elevation of an edge card adapter in accordance with an alternate embodiment of the invention.

Reference is now made to FIG. 5, which is an elevation of an edge card adapter 60 in accordance with an alternate embodiment of the invention. The edge card adapter 60 is similar to the embodiments described above, except that it is intended to permanently engage an edge card 64, so that the edge card adapter 60 and the edge card 64 are not separable.

Housing 62 is provided with an extension piece 66. Two snap-on clips 68 have attachments 70 to the extension piece 66 and extend slightly beyond the free end of the extension piece 66. When the edge card 64 is inserted into the edge card adapter 60, the clips 68 contact flanges 72 of the edge card 64. The clips 68 pivot inward, as indicated by arrows 74, and can be snapped into place within indentations 76 of the edge card 64, so that the edge card 64 is prevented from disengaging from the edge card adapter 60.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art, which would occur to persons skilled in the art upon reading the foregoing description.

The invention claimed is:

1. An edge card connector assembly, comprising:

a housing having a card-side portion, a harness-side portion connectable to a cable and a wall therebetween, the card-side portion including a walled chamber having slots to define a plane of entry for receiving a planar structure therein and adapted to receive a planar structure edgewise therein in a plane of entry, the planar structure having upper and lower surfaces; and a plurality of resilient electrical contacting members extending through the wall and being adapted for electrical connection with the cable in the harness-side portion and with the planar structure in the card-side portion, the upper and lower contacting members being arranged as an upper set of multiple parallel rows above the plane of entry and a lower set of multiple parallel rows below the plane of entry, respectively, such that the received planar structure impinges on the contacting members to urge the upper and lower contacting members away from the plane, and the upper and lower contacting members exert opposing holding pressure on the upper and lower surfaces of the planar structure at respective contact points, the upper and lower contacting members comprising rearward extensions configured as at least one of sockets or pins that are designed to mate with pins or sockets respectively of a mating receptacle on the cable on the harness side.

2. The assembly according to claim 1, wherein the slots terminate at the wall.

3. The assembly according to claim 1, wherein the planar structure is a printed circuit board having electrical contacts that mate with the contacting members at the contact points.

4. The assembly according to claim 1, wherein the housing is provided with snap-on clips that engage respective indentations of the planar structure.

5. The assembly according to claim 1, wherein the contacting members comprise a finger portion and an elbow, the finger portion extending generally from the wall to the elbow, the elbow of at least a portion of the contacting members making galvanic contact with the planar structure at the one of the respective contact points.

6. The assembly according to claim 5, wherein the finger portion is resilient.

7. The assembly according to claim 1, wherein the upper set of rows and the lower set of rows total five rows.

8. The assembly according to claim 7, wherein there are three rows in the upper set of rows and two rows in the lower set of rows.

9. The assembly according to claim 8, wherein there are 34 contacting members.

* * * * *